US006350173B1

(12) United States Patent
Tsang

(10) Patent No.: US 6,350,173 B1
(45) Date of Patent: Feb. 26, 2002

(54) MAGNETIC STEERING ASSEMBLY FOR A TOY VEHICLE

(75) Inventor: Sek Wan Tsang, Hong Kong (CN)

(73) Assignee: Sek Wan Tsang (HK)

( * ) Notice: Subject to any disclaimer, the term of this patent is extended or adjusted under 35 U.S.C. 154(b) by 0 days.

(21) Appl. No.: 09/457,256

(22) Filed: Dec. 8, 1999

(51) Int. Cl.[7] ..... A63H 18/00
(52) U.S. Cl. ..... 446/444
(58) Field of Search ..... 446/444, 129, 446/130, 131, 133, 135, 431, 460, 465

(56) References Cited

U.S. PATENT DOCUMENTS

| | | | | |
|---|---|---|---|---|
| 3,579,906 A | | 5/1971 | La Forge | |
| 4,163,341 A | * | 8/1979 | Jones | |
| 4,471,566 A | * | 9/1984 | Ishimoto | 446/129 |
| 4,563,162 A | * | 1/1986 | Ishimoto | 446/175 |
| 4,571,213 A | * | 2/1986 | Ishimoto | 446/468 |
| 4,816,795 A | | 3/1989 | Suto | |
| 4,854,909 A | | 8/1989 | Ishimoto | |
| 4,881,917 A | * | 11/1989 | Suzuki et al. | 446/468 |
| 4,898,562 A | | 2/1990 | Ishimoto | |
| 5,851,134 A | * | 12/1998 | Chiu | 446/468 |

FOREIGN PATENT DOCUMENTS

| | | | | |
|---|---|---|---|---|
| JP | 4-135591 A | | 5/1992 | |
| JP | 404135591 | * | 5/1992 | 446/129 |

* cited by examiner

*Primary Examiner*—Jacob K. Ackun, Jr.
*Assistant Examiner*—Kurt Fernstrom
(74) *Attorney, Agent, or Firm*—Merchant & Gould P.C.

(57) ABSTRACT

The invention relates to a toy vehicle having steerable wheels, to a steering mechanism for such a vehicle, and to a steering module incorporated in the steering mechanism. The steering module includes a coil having a first end and a second end with a central axis extending between the first and second ends thereof, a slide bar disposed adjacent the first end of the coil and mounted for movement along a substantially linear axis generally perpendicular to the central axis of the coil, and first and second magnets mounted on the slide bar and moveable therewith along the substantially linear axis. The first and second magnets each include a north pole and a south pole, with the north pole of the first magnet facing the first end of the coil and the south pole of the second magnet facing the first end of the coil. The steering mechanism is compact in size with few parts. Further, the steering module is adaptable for use with toy cars of very small size, and the module can be installed at a variety of positions on the toy vehicle.

12 Claims, 8 Drawing Sheets

MAGNETIC STEERING ASSEMBLY FOR A TOY VEHICLE

FIELD

The invention relates generally to toy vehicles, and more particularly to toy vehicles having steerable wheels in order to enable control of the direction of travel of the toy vehicle. The invention has potential application on numerous types of toy vehicles, including toy cars, toy trains, toy trucks and the like. The invention is preferably used on toy vehicles that are radio-controlled, although the invention can be used on any toy vehicle having wheels that can be steered on command by an operator of the vehicle.

BACKGROUND

In the toy vehicle art, there is a need to keep the toy vehicle relatively simple in design with fewer parts, as well as to reduce the size and weight of the toy vehicle and to reduce costs. This is particularly important in toy vehicles having steerable wheels, since the steering mechanism for steering the wheels must be incorporated onto the toy vehicle. Any steering mechanism design that is able to reduce parts and simply design, as well as reduce vehicle size, weight and costs, would be beneficial.

Numerous toy vehicle steering mechanisms for steering toy vehicles are known from the prior art, as illustrated by U.S. Pat. No. 4,163,341; U.S. Pat. No. 4,571,213; U.S. Pat. No. 4,471,566; U.S. Pat. No. 4,898,562; U.S. Pat. No. 4,854,909; U.S. Pat. No. 4,563,162; U.S. Pat. No. 4,816,795; U.S. Pat. No. 3,579,906; and JP 4-135591. While these known mechanisms are generally satisfactory for their intended purpose, there is a continuing need for an improved steering mechanism that saves space, thereby reducing vehicle size, and that saves costs, both in the steering mechanism itself and in the toy vehicle in which the steering mechanism is used.

SUMMARY

An improved steering mechanism for a toy vehicle is provided, particularly a toy vehicle having wheels that are steerable by an operator of the toy vehicle through suitable commands input by the operator. The steering mechanism uses a minimum number of parts and simple, relatively cheap materials. The steering mechanism has a relatively small size, thereby reducing the size of the vehicle, and can be installed at a variety of locations and positions on the vehicle. Further, the design of the steering mechanism improves the steering action on the wheels. Moreover, the small size and improved steering action permits the steering mechanism to be incorporated into very small toy vehicles.

As defined by the claims appended hereto, in one embodiment in accordance with the principles of the invention, a toy vehicle is provided that includes a chassis, first and second wheels pivotally mounted to the chassis, and a steering mechanism mounted on the chassis and operatively connected to the first and second wheels for steering the wheels. The steering mechanism includes a steering module having a coil disposed on the chassis, with the coil having a first end and a second end with a central axis extending between the first and second ends thereof. In addition, the steering module has a first slide bar disposed adjacent the first end of the coil and mounted for movement along a first substantially linear axis generally perpendicular to the central axis of the coil. The first slide bar has a first end operatively connected to the first wheel and a second end operatively connected to the second wheel whereby movement of the first slide bar along the first substantially linear axis results in pivoting movement of the first and second wheels. In addition, first and second magnets are mounted on the first slide bar and are moveable therewith along the first substantially linear axis. The first and second magnets each include a north pole and a south pole, with the north pole of the first magnet facing the first end of the coil and the south pole of the second magnet facing the first end of the coil.

As further defined by the claims appended hereto, in a second embodiment in accordance with the principles of the invention, a steering mechanism is provided for a toy vehicle having first and second wheels. The steering mechanism comprises a steering module including a coil having a first end and a second end with a central axis extending between the first and second ends thereof, and a slide bar disposed adjacent the first end of the coil and mounted for movement along a first substantially linear axis generally perpendicular to the central axis of the coil. The slide bar has a first end operatively connected to the first wheel and a second end operatively connected to the second wheel whereby movement of the slide bar along the first substantially linear axis results in a steering action on the first and second wheels. In addition, first and second magnets are mounted on the slide bar and are moveable therewith along the first substantially linear axis. The first and second magnets each include a north pole and a south pole, with the north pole of the first magnet facing the first end of the coil and the south pole of the second magnet facing the first end of the coil.

As further defined by the claims appended hereto, in a third embodiment in accordance with the principles of the invention, a steering module for a toy vehicle is provided. The steering module includes a coil having a first end and a second end with a central axis extending between the first and second ends thereof, a slide bar disposed adjacent the first end of the coil and mounted for movement along a substantially linear axis generally perpendicular to the central axis of the coil, and first and second magnets mounted on the slide bar and moveable therewith along the substantially linear axis. The first and second magnets each include a north pole and a south pole, with the north pole of the first magnet facing the first end of the coil and the south pole of the second magnet facing the first end of the coil.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

DETAILED DESCRIPTION

The invention relates to a toy vehicle having steerable wheels, to a steering mechanism for such a vehicle, and to a steering module incorporated in the steering mechanism. The design of the steering module is simple with few parts, thereby permitting a reduction in the size and weight of the steering mechanism and of the toy vehicle itself Further, the steering module is adaptable for use with toy cars of very small size, and the module can be installed at a variety of positions on the toy vehicle.

With reference now to the figures, one implementation of a toy vehicle 10 utilizing a steering mechanism 12 with a steering module 14 of the invention is illustrated. Only the front end of the toy vehicle 10 is illustrated in the figures, it being understood that the rear end of the vehicle includes an additional set of wheels. The toy vehicle 10 is preferably of the type whose rear wheels are driven by an electric motor (not shown) suitably positioned on the vehicle. Power for running the motor is provided by a power source 16, such as one or more batteries, positioned on the vehicle. The vehicle is preferably operated by a suitable wireless control system of a type generally known in the art.

Figure 1:
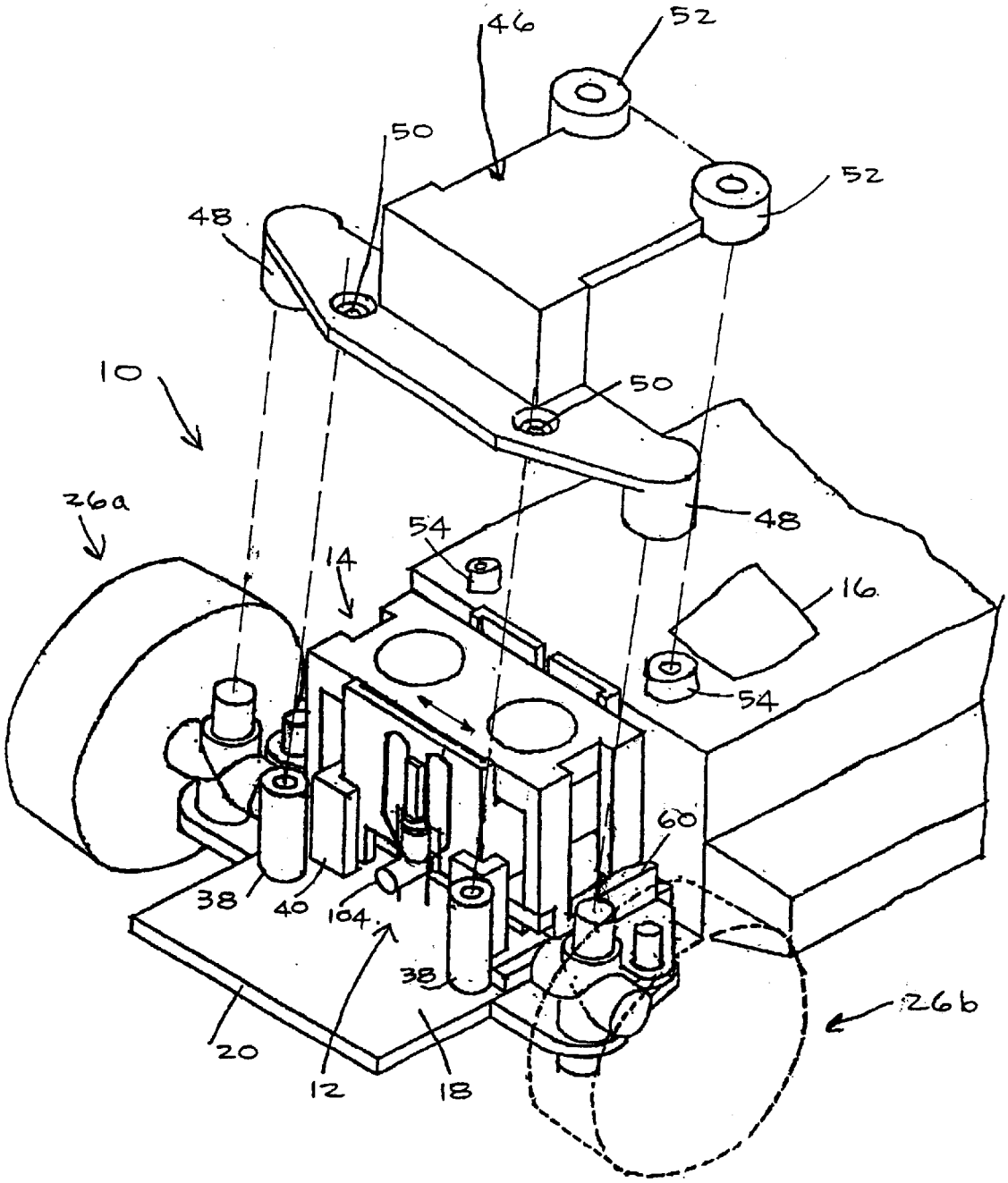
FIG. 1 is a perspective view of the front end of a toy vehicle incorporating the steering mechanism of the invention.
Figure 4:
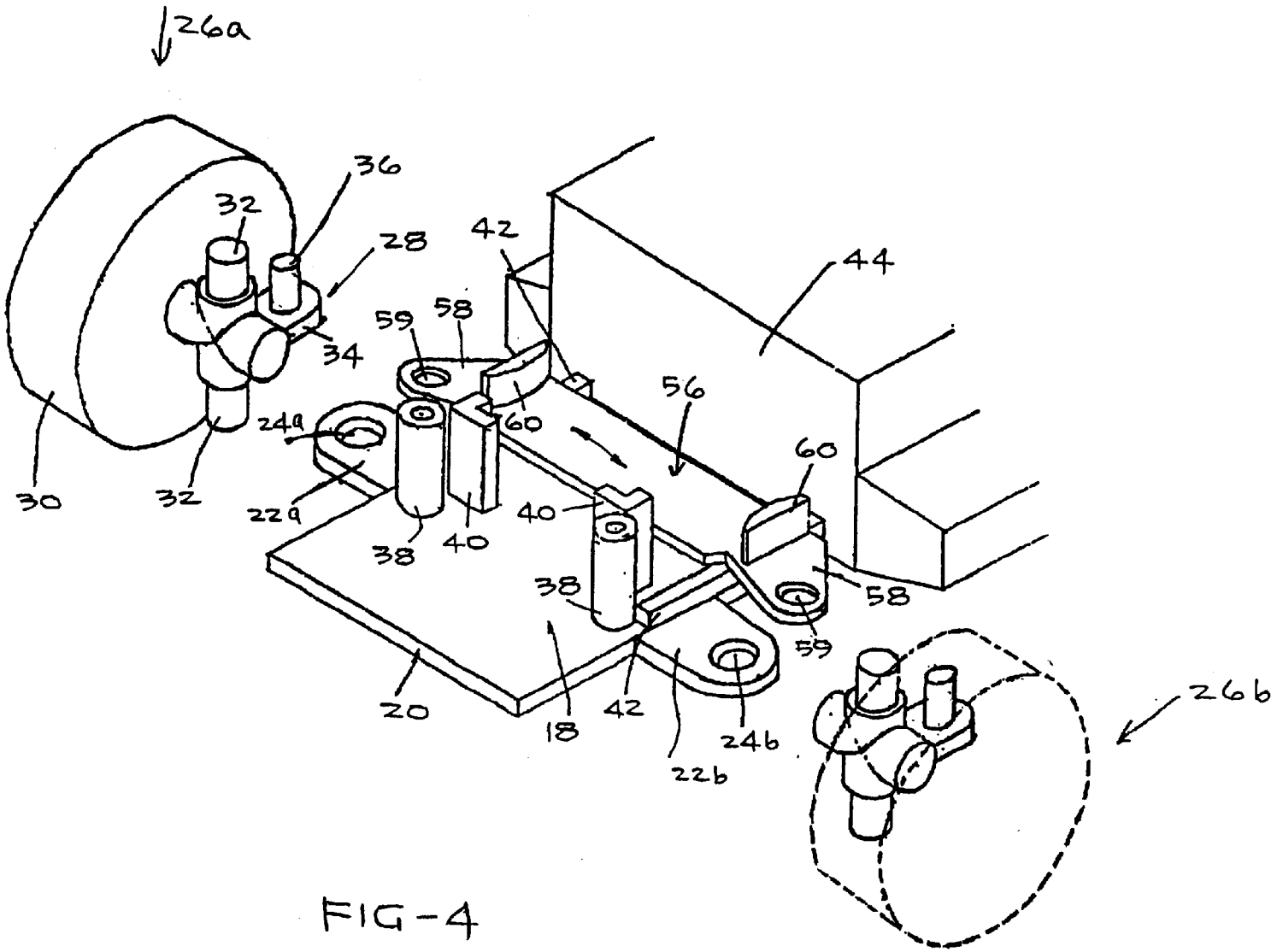
FIG. 4 depicts other elements of the steering mechanism.

Referring now to FIGS. 1 and 4, the toy vehicle 10 includes a chassis 18 with a front end 20. Projecting from each side of the chassis 18 are tabs 22*a*, 22*b* each formed with a respective hole 24*a*, 24*b* therein. Right and left wheel assemblies 26*a*, 26*b* are mounted to the tabs 22*a*, 22*b* to permit pivoting movement of each wheel assembly. The wheel assemblies 26*a*, 26*b* are identical and therefore only the wheel assembly 26*a* will be described in detail.

The wheel assembly 26*a* includes a spindle 28 and a wheel 30 that is rotatably mounted on the spindle 28. The spindle 28 includes pins 32 extending from the top and bottom thereof, with the bottom pin 32 being rotatably disposed within the hole 24*a* to enable the spindle 28, and thus the wheel assembly, to pivot about a generally vertical axis. Extending rearwardly from the spindle 28 is an arm 34 with a vertical pin 36 adjacent the end thereof, the purpose of which will be described below.

Extending upwardly from the chassis 18 are a pair of support posts 38 each having a threaded hole, and a pair of right angle members 40. Further, a pair of rails 42 are disposed on the top surface of the chassis 18 at the sides thereof, and extend forwardly from a central portion 44 of the vehicle 10 to adjacent the support posts 38. As shown in FIG. 1, a cover 46 is provided in order to retain the wheels assemblies 26*a*, 26*b*, the steering mechanism 12 and the steering module 14 in place on the chassis 18. The cover 46 includes a pair of caps 48 that are designed to fit over, and rotatably support, the top pins 32 on the spindles 28. The cover 46 also has a pair of apertures 50 that align with the threaded holes in the support posts 38 whereby the cover 46 can be fastened to the chassis 18 using screws. A pair of bosses 52 are provided at the rear end of the cover 46 that cooperate with corresponding bosses 54 provided on the central portion 44 of the vehicle to permit attachment of the rear end of the cover.

As shown in FIG. 4, an actuating bar 56 is positioned on top of the rails 42 between the right angle member 40 and the central portion 44. The actuating bar 56, together with the steering module 14 to be later described, form the steering mechanism 12 of the invention. As indicated by the arrows in FIG. 4, the actuating bar 56 is slideably disposed on the chassis 18 for sliding movement to the left and to the right along a generally linear axis. The actuating bar 56 includes tabs 58 that project from the sides of the chassis 18, with each tab 58 including a hole 59 therein to receive the respective pin 36 on the spindle arm 34, as best seen in FIG. 1. Thus, as the actuating bar 56 moves to the right and the left, the movement is transmitted through the spindle arms 34 to the spindle 28 thereby causing the wheels 30 to steer to the right and the left.

Returning to FIG. 1, it is the steering module 14 that causes the actuating bar 56 to move to the right and left. The steering module 14 is positioned between a pair of tabs 60 projecting upward from the actuating bar 56 whereby movement of a portion of the steering module 14 to the right and to the left, shown by the arrows in FIG. 1, is transmitted to the actuating bar 56. As mentioned above, the steering module 14 and the actuating bar 56 form the steering mechanism 12 of the toy vehicle.

Figure 2:
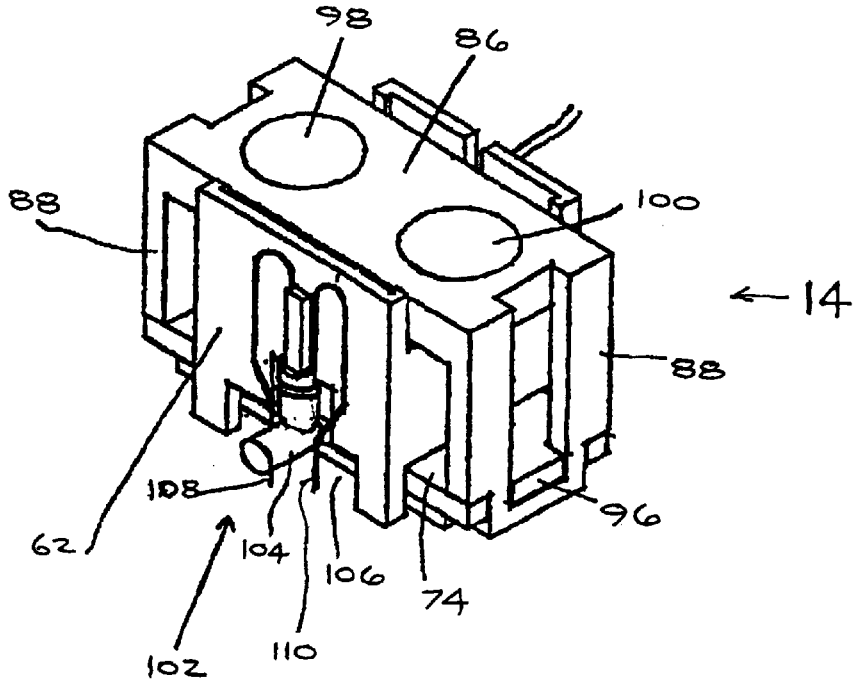
FIG. 2 is a perspective view of the steering module utilized in the steering mechanism.
Figure 3:
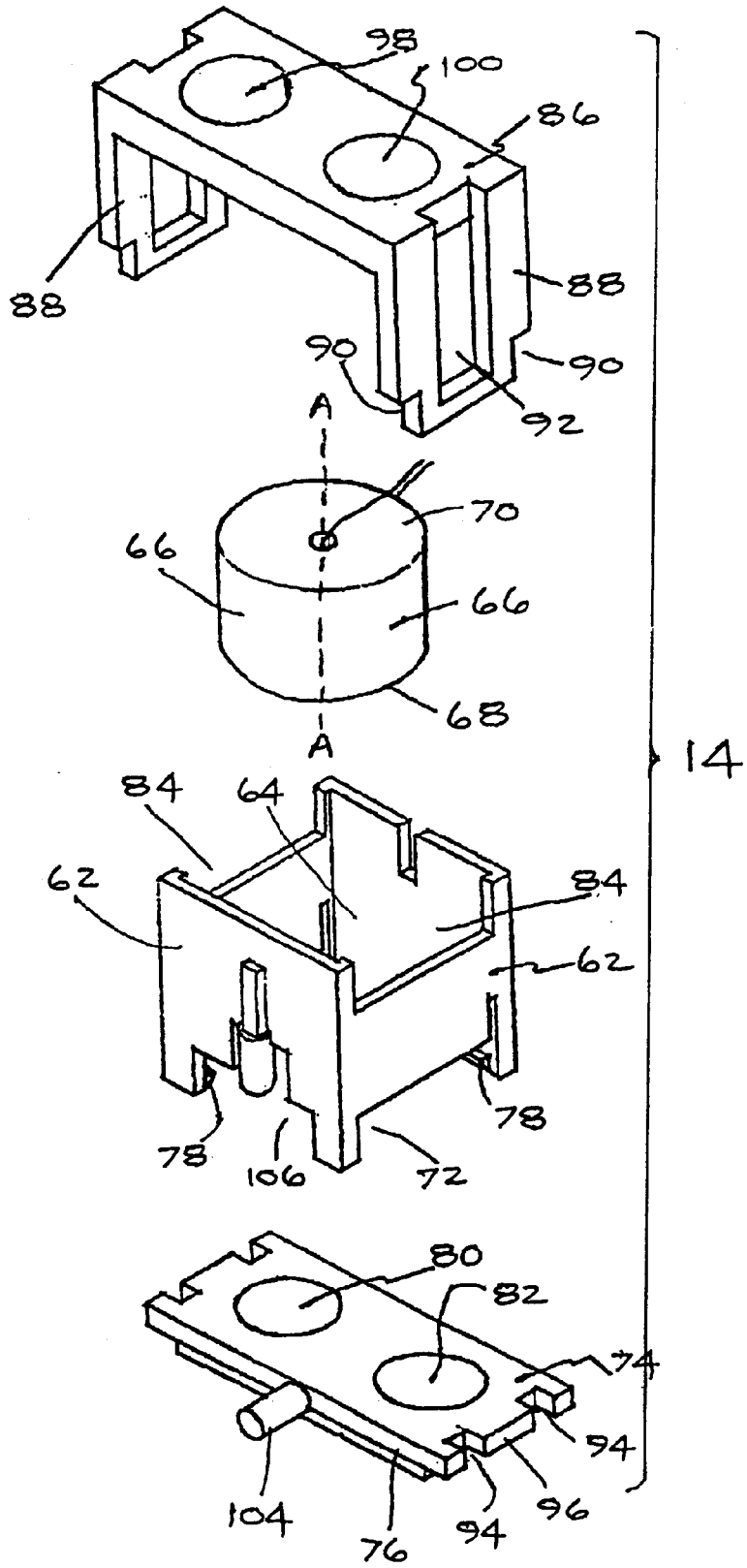
FIG. 3 is an exploded view illustrating components of the steering module.

FIGS. 2 and 3 illustrate the steering module 14 in detail. The module 14 includes a generally rectangular frame 62, which as shown in FIG. 1, cooperates with the right angle members 40 and the central portion 44 whereby the frame 62 is fixed on the chassis 18. The frame 62 is preferably made from plastic in order to reduce vehicle weight and costs. The frame 62 includes a generally hollow central area 64 that receives therein a coil 66. The coil 66 has a first end 68 and a second end 70 with an axis A—A extending between the ends 68, 70 through the center of the coil. The coil 66 is sized to fit snugly within the hollow area 64 to thereby retain the coil within the frame 62.

The bottom of the frame 62 includes a cut-out section 72 in opposite side walls thereof in order to receive a first slide bar 74. The slide bar 74, which is preferably made from plastic to reduce weight and costs, includes rails 76 cut on each side thereof that cooperate with rails 78 formed on opposite walls of the frame 62, whereby the slide bar 74 is slideable to the right and left relative to the frame. Mounted on the slide bar 74, at spaced locations thereon, are a pair of magnetic disks 80, 82.

The top of the frame 62 also includes a cut-out section 84 in opposite side walls thereof that receive a second slide bar 86. The second slide bar 86, like the first slide bar 74, is preferably made from plastic to weight and costs. Extending downward from opposite ends of the slide bar 86 are connecting arms 88, each of which is provided with notches 90 at the ends thereof and a central slot 92. The ends of the first slide bar 74 are provided with a pair of spaced notches 94 between which is a tab 96. As shown in FIG. 2, the ends of the connecting arms 88 are designed to engage with the ends of the first slide bar 74, with the tab 96 fitting into the slot 92 and the notches 90, 94 cooperating with each other, whereby the first and second slide bars 74, 86 are connected together so as to move in unison to the right and the left.

Further, like the first slide bar 74, the second slide bar 86 is also provided with a pair of magnetic disks 98, 100 mounted at spaced locations thereon. The slide bars 74, 86 and magnetic disks 80, 82, 98, 100 are positioned such that the disk 80 is generally vertically aligned with the disk 98, and the disk 82 is generally vertically aligned with the disk 100. Although the magnets 80, 82, 98, 1 00 have been described as being discs, it is to be realized that other shapes could be used for the magnets as well.

Figure 5:
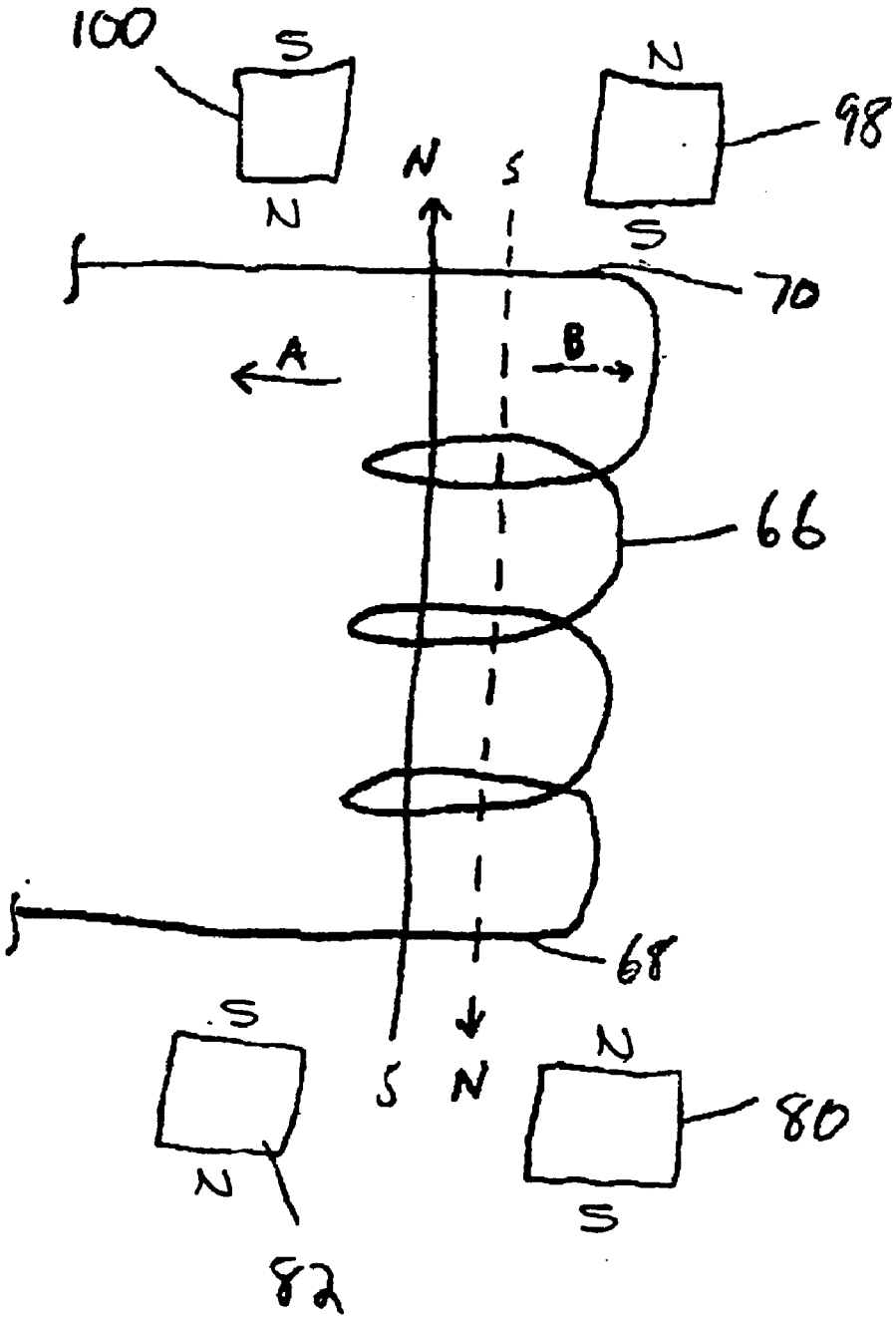
FIG. 5 is a schematic depicting the interaction of the coil and the magnets of the steering module.

As shown in FIG. 5, each of the magnets 80, 82, 98, 100 includes a north pole and a south pole. For the slide bar 74, the magnets 80, 82 are arranged such that the north pole of the magnet 80 faces the end 68 of the coil 66 while the south pole of the magnet 82 faces the end 68. Likewise, for the slide bar 86, the magnets 98, 100 are arranged such that the south pole of the magnet 98 faces the end 70 of the coil 66, while the north pole of the magnet 100 faces the end 70.

By controlling the direction of current through the coil 66, thereby controlling its polarity, the slide bars 74, 86 can be forced to the right or to the left due to attraction and repulsion of the respective magnets. For instance, as shown in FIG. 5, when current is directed through the coil 66 such that the N-polarity points upward, the magnets 80, 98 are attracted in the direction of arrow A while the magnets 82, 100 are repulsed in the direction of arrow A, thereby causing the slide bars 74, 86 to shift resulting in a steering action on the wheels. When the current is reversed such that the N-polarity points downward, the magnets 80, 98 are repulsed in the direction of dashed arrow B while the magnets 82, 100 are attracted in the direction of dashed arrow B, thereby causing the slide bars 74, 86 to shift resulting in a steering action on the wheels. Circuitry for controlling the direction of current flow through the coil 66 is known in the art and need not be described herein. The electricity for the current flow is provided by the power source 16.

A biasing mechanism 102 is also provided in order to bias the slide bars 74, 86 to a central position once current flow through the coil 66 is stopped. As shown in FIGS. 2 and 3, a pin 104 projects from the slide bar 74 through a cut-out 106 provided in the frame 62. A pair of spring arms 108, 110 are disposed on either side of the pin 104 for biasing the slide bar 74 back to its central position after sliding either left or right. The spring arms 108, 110 preferably form the opposite ends of the same single piece of flexible wire that is suitably fixed to the frame 62. However, the spring arms could be from separate wire elements that are each fixed to the frame.

Figure 6:
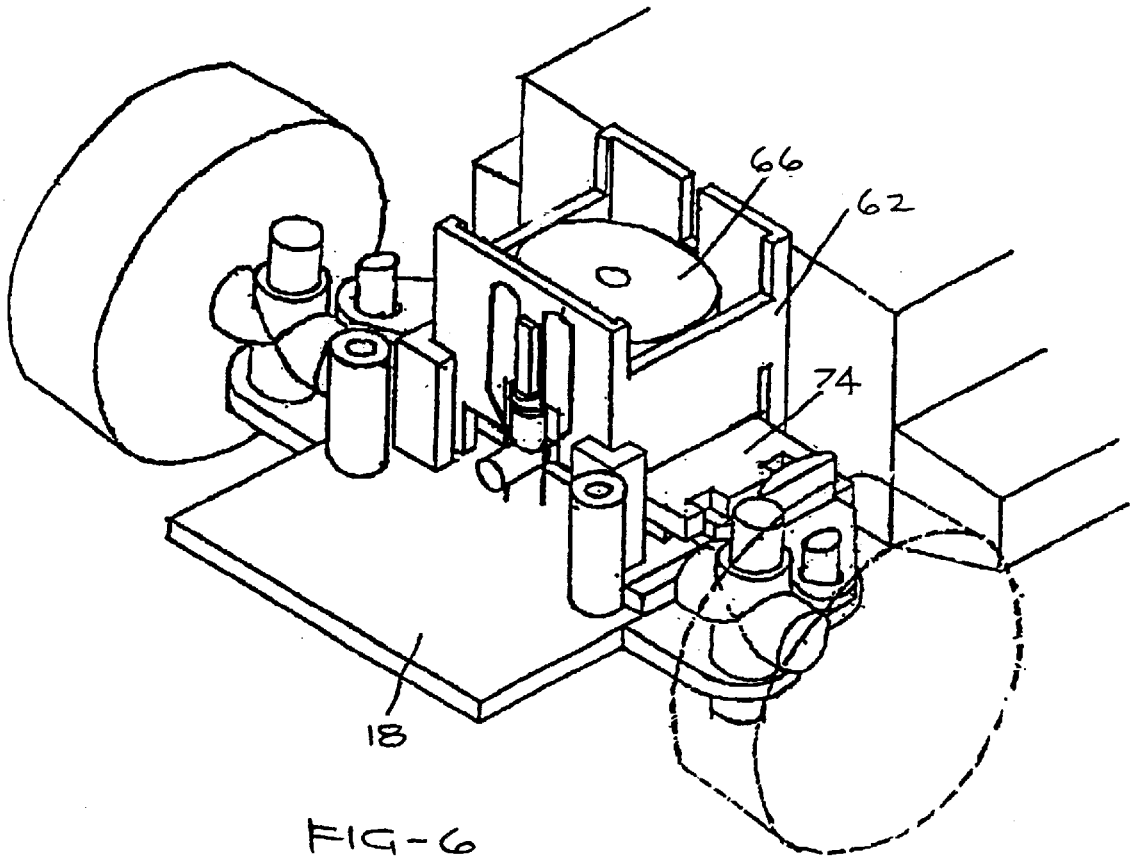
FIG. 6 is a perspective view of the front end of a toy vehicle incorporating an alternative embodiment of a steering mechanism.
Figure 7:
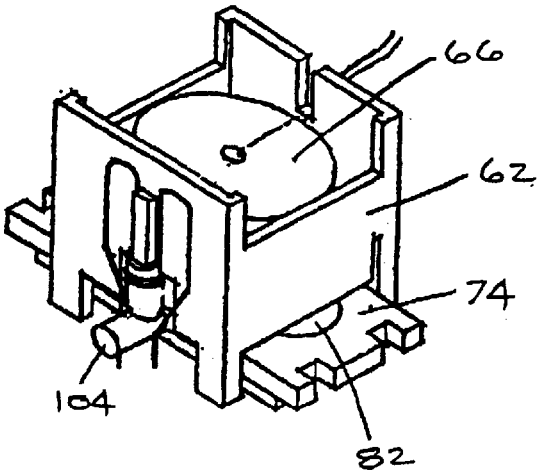
FIG. 7 is a perspective view of the steering module utilized in the steering mechanism of FIG. 6.

The embodiment described thus far and shown in FIGS. 1–5 has utilized a pair of slide bars 74, 86. The use of two slide bars and their corresponding magnets provides the maximum amount of steering force. However, when a smaller steering force will suffice, it is possible to utilize the steering module 14 with only a single slide bar. Referring to FIGS. 6 and 7, it is seen that the second slide bar 86 of the steering module 14 has been removed, and only the first slide bar 74 is present. This embodiment permits use of the steering module on smaller toy vehicles and those toy vehicles that require a smaller amount of steering force.

Figure 8:
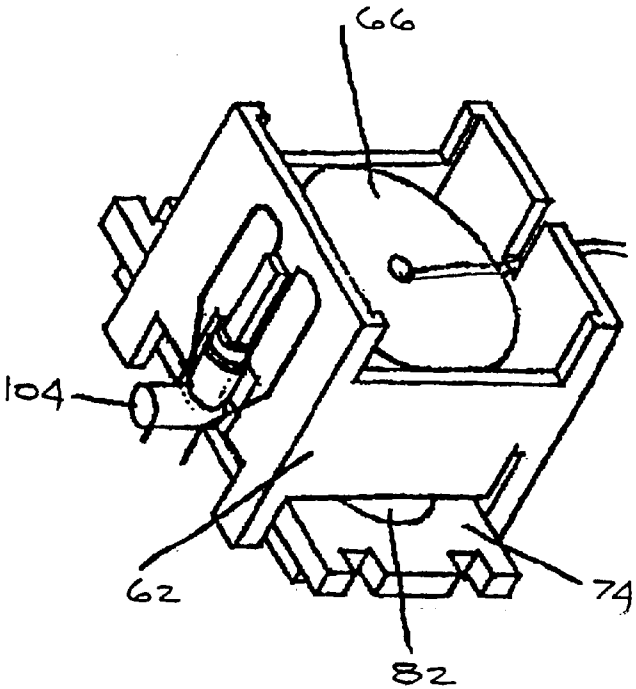
FIG. 8 illustrates an alternative orientation of the steering module.

In addition, the invention thus far described has had the core 66 of the steering module 14 oriented such that the axis A—A thereof extends generally vertically relative to the vehicle. However, it is to be realized that the steering module 14 could be oriented in such a manner that the axis A—A of the core 66 extends generally forward and aft of the toy vehicle. Such an orientation is illustrated in FIG. 8. The actuating bar 56 would have to be suitably modified in order to actuated by the slide bar. The embodiment illustrated in FIG. 8 could also be used with the second slide bar as well.

Figure 9:
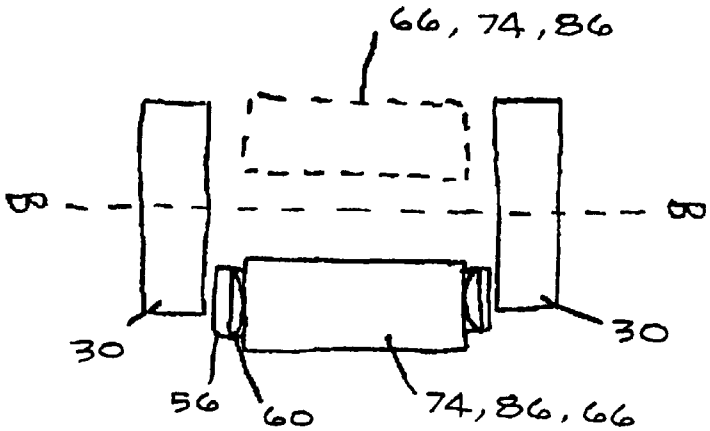
FIG. 9 illustrates the position of the steering module relative to a rotation axis of the wheels.

One of the advantages provided by the steering module 14 and steering mechanism 12 described herein is that they are compact and take up very little space on the vehicle. Therefore, the vehicle size can be reduced. To illustrate the compact nature of the invention, reference should be made to FIG. 9, which show the front wheels 30, each of which is rotatable about a respective rotation axis forming a common axis B—B. As FIG. 9 schematically illustrates, the actuating bar 56 and the slide bars 74, 86 and the coil 66 of the steering module 14, are positioned entirely to the rear of the axis B—B. Likewise, in keeping with the flexible nature of the invention, FIG. 9 illustrates in dashed lines that the actuating bar, slide bars and coil can be positioned entirely in front of the axis B—B. Thus, the steering mechanism 12 takes up very little fore and aft space, and it can be positioned at different locations depending upon the space that is available on the toy vehicle.

Figure 10:
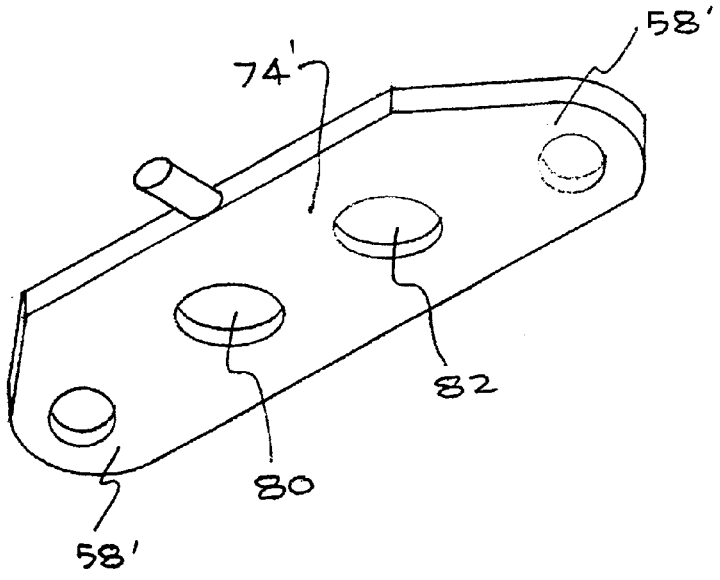
FIG. 10 illustrates a variation in which the actuating bar and the first slide bar are combined into a single, one-piece unit.

FIG. 10 illustrates a variation in which the actuating bar 56 and the first slide bar 74 are combined into an integral, one-piece unit, in which the slide bar 74' is provided with tabs 58' at both ends. Thus, in this version, the steering mechanism is comprised of only the steering module itself, as the actuating bar has essentially been eliminated. This design further reduces size, weight and costs of the toy vehicle.

Figure 11:
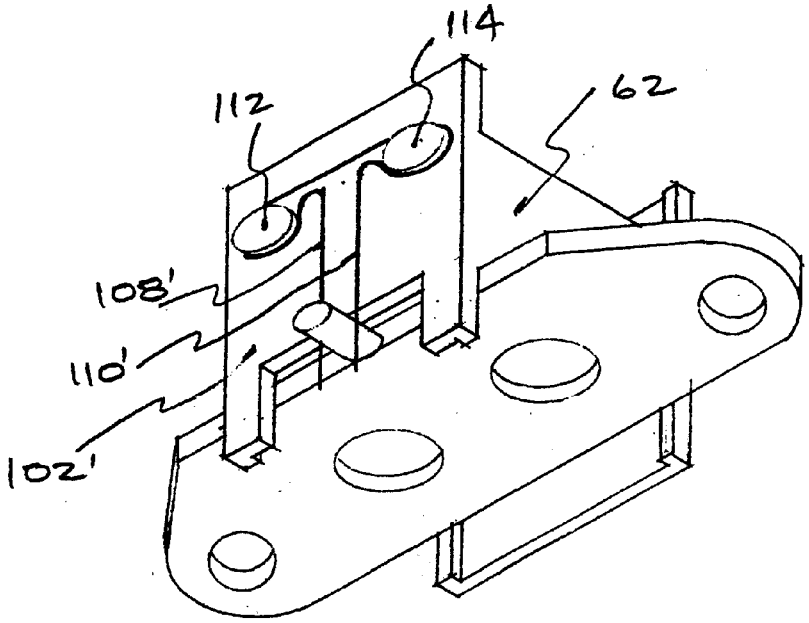
FIG. 11 illustrates a variation of the biasing mechanism.

FIG. 11 illustrates a variation utilizing a biasing mechanism 102' in which the spring arms 108', 110' are separate wire elements fixed to respective mounting elements 112, 114 on the frame 62.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A toy vehicle, comprising:

a chassis;

first and second wheels pivotally mounted to the chassis; and a steering mechanism mounted on the chassis and operatively connected to the fist and second wheels for steering the wheels, the steering mechanism including a steering module having;

a) a coil disposed on the chassis, the coil having a first end and a second end with a central axis extending between the first and second ends thereof;

b) a first slide bar disposed adjacent the first end of the coil mounted so as to be moveable perpendicular to the central axis of the coil, the first slide bar having a first end operatively connected to the first wheel and a second end operatively connected to the second wheel whereby movement of the first slide bar results in pivoting movement of the first and second wheels;

c) first and second magnets mounted on the first slide bar and moveable therewith perpendicular to the central axis of the coil, the first and second magnets each including a north pole and a south pole, the north pole of the first magnet facing the first end of the coil and the south pole of the second magnet facing the first end of the coil;

wherein the steering mechanism further includes an actuating bar mounted on the chassis for movement perpendicular to the central axis of the coil, the actuating bar are operatively having a first end operatively connected to the first wheel and a second end operatively connected to the second wheel, and the first slide bar and the actuating bar are operatively engaged whereby movement of the first slide bar causes movement of the actuating bar perpendicular to the central axis of the coil; and wherein the wheels are each rotatable about a respective rotation axis, and wherein the coil, the first slide bar and the first and second magnets are all disposed either entirely forward or entirely rearward of the rotation axes.

2. The toy vehicle according to claim 1, wherein the wheels are front wheels of the toy vehicle.

3. The toy vehicle according to claim 1, further including a biasing mechanism engaged with the first slide bar biasing the first slide bar to a central position.

4. A toy vehicle, comprising:

a chassis;

first and second wheels pivotally mounted to the chassis; and a steering mechanism mounted on the chassis and operatively connected to the first and second wheels for steering the wheels, the steering mechanism including a steering module having:

a) a coil disposed on the chassis, the coil having a first end and a second end with a central axis extending between the first and second ends thereof;

b) a first slide bar disposed adjacent the first end of the coil and mounted so as to be movable perpendicular to the central axis of the coil, the first slide bar having a first end operatively connected to the first wheel and a second end operatively connected to the second wheel whereby movement of the first slide bar results in pivoting movement of the first and second wheels;

c) first and second magnets mounted on the first slide bar and moveable therewith perpendicular to the central axis of the coil, the first and second magnets each including a north pole and a south pole, the north pole of the first magnet facing the first end of the coil and the south pole of the second magnet facing the first end of the coil;

d) a second slide bar disposed adjacent the second end of the coil, the second slide bar being connected to the first slide bar for movement therewith; and e) third and fourth magnets mounted on the second slide bar and moveable therewith, the third and fourth magnets each including a north pole and a south pole, the north pole of the third magnet facing the second end of the coil and the south pole of the fourth magnet facing the second end of the coil; and wherein the wheels are each rotatable about a respective rotation axis, and wherein the coil, the first slide bar and the first and second magnets are all disposed either entirely forward or entirely rearward of the rotation axes.

5. The toy vehicle according to claim 4, wherein the steering mechanism further includes a frame fixed to the chassis, the coil being disposed within the frame, and the first and second slide bars are slideably supported by the frame.

6. A steering mechanism for a toy vehicle having first and second wheels, the steering mechanism comprising:

a steering module including a coil having a first end and a second end with a central axis extending between the first and second ends thereof; a first slide bar disposed adjacent the first end of the coil and mounted so as to be movable perpendicular to the central axis of the coil, the first slide bar having a first end operatively connected to the first wheel and a second end operatively connected to the second wheel whereby movement of the first slide bar results in a steering action on the first and second wheels;

first and second magnets mounted on the first slide bar and moveable therewith perpendicular to the central axis of the coil, the first and second magnets each including a north pole and a south pole, the north pole of the first magnet facing the first end of the coil and the south pole of the second magnet facing the first end of the coil;

an actuating bar mounted for movement perpendicular to the central axis of the coil, the actuating bar having a first end operatively connected to the first wheel and a second end operatively connected to the second wheel, and the first slide bar and the actuating bar are operatively engaged whereby movement of the first slide bar causes movement of the actuating bar perpendicular to the central axis of the coil; and wherein the wheels are each rotatable about a respective rotation axis, and wherein the coil, the first slide bar and the first and second magnets are all disposed either entirely forward or entirely rearward of the rotation axes.

7. The steering mechanism according to claim 6, wherein the first and second wheels are front wheels of the toy vehicle.

8. The steering mechanism according to claim 6, further including a biasing mechanism engaged with the first slide bar and the second slide bar biasing the first slide bar to a central position.

9. A steering mechanism for a toy vehicle having first and second wheels, the steering mechanism comprising:

a steering module including a coil having a first end and a second end with a central axis extending between the first and second ends thereof;

a first slide bar disposed adjacent the first end of the coil and mounted so as to be movable perpendicular to the central axis of the coil, the first slide bar having a first end operatively connected to the first wheel and a second end operatively connected to the second wheel whereby movement of the first slide bar results in a steering action on the first and second wheels;

first and second magnets mounted on the first slide bar and moveable therewith perpendicular to the central axis of the coil, the first and second magnets each including a north pole and a south pole, the north pole of the first magnet facing the first end of the coil and the south pole of the second magnet facing the first end of the coil;

a second slide bar disposed adjacent the second end of the coil, the second slide bar being connected to the first slide bar for movement therewith; and third and fourth magnets mounted on the second slide bar and moveable therewith, the third and fourth magnets each including a north pole and a south pole, the north pole of the third magnet facing the second end of the coil and the south pole of the fourth magnet facing the second end of the coil, wherein the wheels are each rotatable about a respective rotation axis, and wherein the coil, the first slide bar and the first and second magnets are all disposed either entirely forward or entirely rearward of the rotation axes.

10. The steering mechanism according to claim 9, further including a frame fixed to the toy vehicle, the coil being disposed within the frame, and the first and second slide bars are slideably supported by the frame.

11. A steering module for a toy vehicle, comprising:

a coil having a first end and a second end with a central axis extending between the first and second ends thereof;

a frame, said coil being disposed within said frame;

a first slide bar disposed adjacent the first end of the coil and slidably supported on said frame for movement perpendicular to the central axis of the coil;

first and second magnets mounted on the first slide bar and moveable therewith perpendicular to the central axis of the coil, the first and second magnets each including a north pole and a south pole, the north pole of the first magnet facing the first end of the coil and the south pole of the second magnet facing the first end of the coil;

a second slide bar disposed adjacent the second end of the coil and slidably supported by said frame, the second slide bar being connected to the first slide bar for movement therewith; and third and fourth magnets mounted on the second slide bar and moveable therewith, the third and fourth magnets each including a north pole and a south pole, the north pole of the third magnet facing the second end of the coil and the south pole of the fourth magnet facing the second end of the coil.

12. The steering module according to claim 11, further including a biasing mechanism engaged with the first slide bar biasing the first slide bar to a central position.

* * * * *